US005180006A

United States Patent [19]

Marsais et al.

[11] Patent Number: 5,180,006

[45] Date of Patent: Jan. 19, 1993

[54] DEVICE FOR MOUNTING TWO PIPE CONNECTIONS ON TWO ADJACENT APERTURES OF A HEAT EXCHANGER CASING

[75] Inventors: Christian Marsais, Epernon; Frédéric Letrange, Nanterre, both of France

[73] Assignee: Valeo Thermique Moteur, Le Mesnil-Saint-Denis, France

[21] Appl. No.: 900,411

[22] Filed: Jun. 18, 1992

[30] Foreign Application Priority Data

Jun. 19, 1991 [FR] France ..... 91 075422

[51] Int. Cl.[5] ..... F28F 9/00

[52] U.S. Cl. ..... 165/178; 165/78; 165/916; 285/26; 285/137.1

[58] Field of Search ..... 165/76, 78, 178, 916; 285/26, 29, 137.1, 921

[56] References Cited

U.S. PATENT DOCUMENTS

| | | | |
|---|---|---|---|
| 2,222,721 | 11/1940 | Ramsaur et al. | 165/167 |
| 3,848,901 | 11/1974 | Hoffman | 285/137.1 |
| 4,191,244 | 3/1980 | Keske | 165/69 |
| 4,247,133 | 1/1981 | Möller | 285/4 |
| 4,479,668 | 10/1984 | Jacquet | 285/137.1 |
| 4,696,339 | 9/1987 | Schwarz | 165/51 |
| 4,765,658 | 8/1988 | Reche | 285/137.1 |
| 4,786,085 | 11/1988 | Sauer et al. | 285/24 |
| 4,887,849 | 12/1989 | Briet | 285/91 |
| 5,022,461 | 6/1991 | Potier et al. | 165/76 |

*Primary Examiner*—Allen J. Flanigan
*Attorney, Agent, or Firm*—Morgan & Finnegan

[57] ABSTRACT

A heat exchanger has a casing formed with two adjacent apertures, and two tubular pipe connections are mounted on the casing so as to communicate with these apertures in the latter.

The two pipe connection are fixed with respect to a common base plate which is fastened to the casing by snap-fitting means, with the base plate having two orifices which communicate respectively with the two pipe connections and which are arranged to be aligned with the apertures in the casing, a sealing member being interposed between the base plate and the casing. The invention is especially applicable to radiators for cooling motor vehicle engine lubricating oil.

9 Claims, 2 Drawing Sheets

DEVICE FOR MOUNTING TWO PIPE CONNECTIONS ON TWO ADJACENT APERTURES OF A HEAT EXCHANGER CASING

FIELD OF THE INVENTION

This invention relates to a device for mounting two tubular pipe connections on two adjacent apertures of a casing of a heat exchanger, especially a heat exchanger for cooling lubricating oil for the engine of a motor vehicle.

BACKGROUND OF THE INVENTION

In heat exchanges of this kind, the two pipe connections serve respectively as an inlet and an outlet for a liquid, for example a water and glycol mixture, for cooling the oil which flows through a chamber mounted in the interior of the casing. This chamber generally comprises a stack of pairs of half plates, with the oil entering and leaving through two conduits which are sealingly attached through the wall of the casing. Such a heat exchanger is conventionally mounted between the engine casing and the oil filter that is associated with it.

Up to the present time, the two tubular pipe connections are brazed or welded on to the corresponding apertures of the housing, and this gives rise to a number of drawbacks. Firstly, fitting of the two pipe connections necessitates a brazing or welding operation and therefore an additional operation during the manufacturing process. In addition, this arrangement involves making the heat exchanger of such a size as to be inconvenient in the case where the pipe connections are of bent configurations.

DISCUSSION OF THE INVENTION

A main object of the invention is to overcome the above mentioned drawbacks.

According to the invention, a device for mounting two tubular pipe connections on two adjacent apertures of a casing of a heat exchanger is characterised in that both pipe connections are joined to a common base plate which is arranged to be carried by snap-fitting means on the casing, the base plate defining two orifices which communicate respectively with the two pipe connections and which are adapted to be aligned with the apertures of the casing, and in that a sealing member is interposed between the base plate and the casing in the vicinity of the apertures and orifices.

It is thus made possible to fit in a simple snap-fitting operation both of the two pipe connections simultaneously on to the casing, with a sealing member interposed to provide sealing between the pipe connections and the casing.

According to a preferred feature of the invention, the base plate includes two flexible lugs, which extend in directions substantially parallel to each other, with each said lug having a tooth adapted to snap-fit into a hole formed in a tongue which is fixed with respect to the casing.

Preferably, each of the said tongues projects from a cover plate of the casing, while the said apertures are formed through a side wall of the casing.

Preferably, each of the two said apertures of the casing is surrounded by a collar portion which projects into the interior of the casing, each of the two orifices of the base plate being surrounded by a collar portion which is arranged to be introduced into the corresponding aperture of the casing.

According to a further preferred feature of the invention, the sealing member includes a body portion having two through apertures, each of which is surrounded by a cylindrical collar portion which is arranged to be compressed between the collar portion of the corresponding aperture of the casing and the collar portion of the corresponding orifice of the base plate when the latter is snap-fitted on to the casing. Thus the two collar portions of the sealing member are compressed during the snap-fitting of the base plate on to the casing, so providing the necessary sealing effect.

According to yet another preferred feature of the invention, the base plate includes a slot which may for example serve for the attachment of the heat exchanger on to the engine casing.

Each of the tubular pipe connections is preferably of bent configuration, defining for example a right-angle bend.

According to yet a further preferred feature of the invention, each of the tubular pipe connections has a slot for positioning a pipe connecting the heat exchanger to associated apparatus.

The base plate and its two tubular pipe connections are preferably made integrally with each other by moulding in a plastics material, for example of the polyamide type.

A preferred embodiment of the invention will be described below, by way of example and with reference to the accompanying drawings.

DESCRIPTION OF A PREFERRED EMBODIMENT OF THE INVENTION

Reference is made first, in particular, to FIGS. 1, 2, 3 and 5 showing a mounting device 10 in accordance with the invention, which is Provided on a casing 12 of a heat exchanger. In this particular embodiment, this heat exchanger is a radiator for cooling the lubricating oil for the engine of a motor vehicle.

Figure 5:
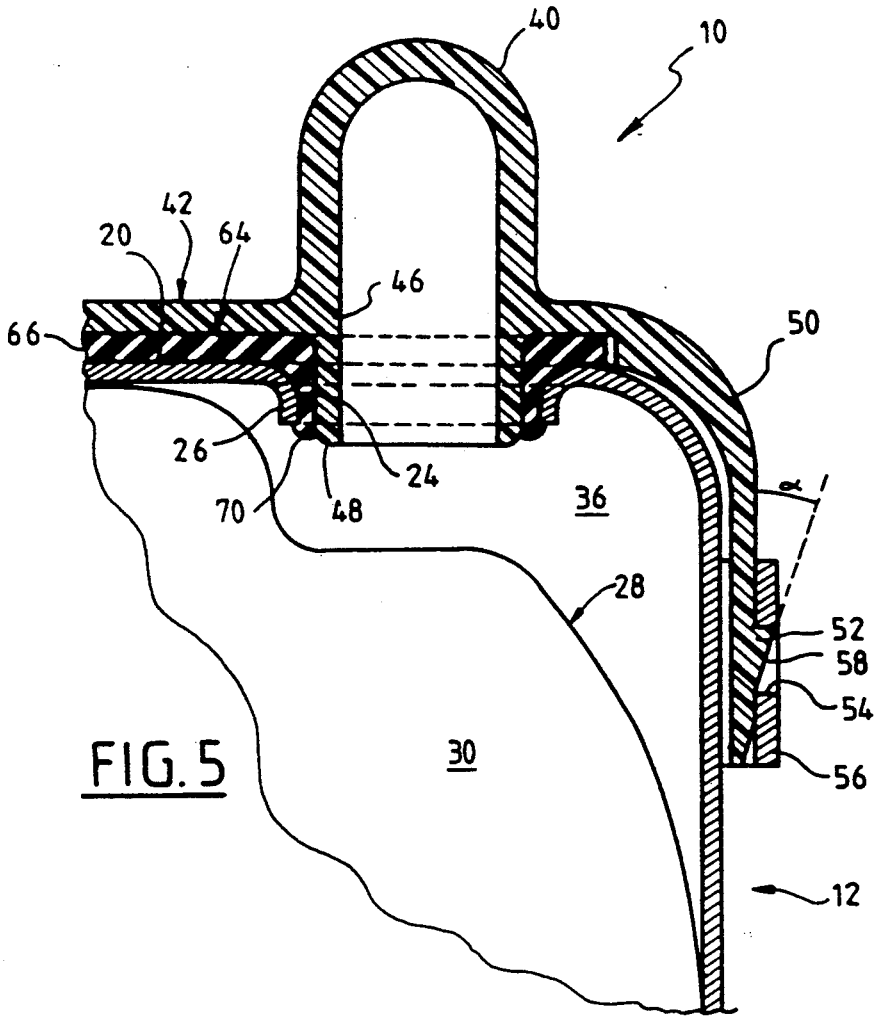
FIG. 5 is a partial view on a larger scale, shown in cross section taken on the line V—V in FIG. 2.

The casing 12 has side walls with parallel generatrices, comprising a semi-circular wall 14 which is joined, through two flat walls 16 and 18 and two short, curved corner wall portions 22, to a flat side wall 20. Two adjacent apertures 24 are formed through the wall 20. Each of these apertures 24 is surrounded by a collar portion 26 which projects into the interior of the casing (FIG. 5).

A chamber 28, defined by a stack of pairs of half plates 30 (see FIG. 5) and intended to contain the oil which is to be cooled, is arranged within the casing 12. The oil flows into the chamber 28 through inlet and outlet ducts (not shown) which extend into the casing 12 in a sealed manner. The casing is further delimited by a base plate 32 (FIG. 2) and an opposed cover plate 34 which can be seen in FIGS. 1, 2 and 3.

The oil flowing through the chamber 28 is cooled by heat exchange with a cooling liquid, for example a mixture of water and glycol, which flows in the internal space 36 (FIG. 5) which is defined between the casing 12 and the chamber 28. The inlet and outlet for the cooling liquid comprise two tubular pipe connections 38 and 40, which in this particular example are each bent to form a right angle. These two tubular pipe connections are joined to a common base plate 42 which is snap-fitted on to the casing 12 of the heat exchanger.

The base plate 42 comprises a generally flat body portion 44 from which the two tubular pipe connections 38 and 40 project. The body portion 44 defines two openings or orifices 46 which are spaced apart by the same distance as the two apertures 26 of the casing. Each of the orifices 46 of the base plate 42 is surrounded by a collar portion 48, which projects from the base plate in a direction opposite to that of the corresponding pipe connection. Each collar portion 48 is arranged to be introduced into the corresponding aperture 24 of the casing (see FIG. 5). The base plate 42 also has two flexible lugs 50 which are joined if the body portion 44 and which extend in directions substantially parallel to each other. Each flexible lug 50 carries a ramp tooth 52 adapted to be snap-fitted into a rectangular hole 54 formed through a tongue 56, which is fixed to the cover plate 34 of the casing.

Figure 1:
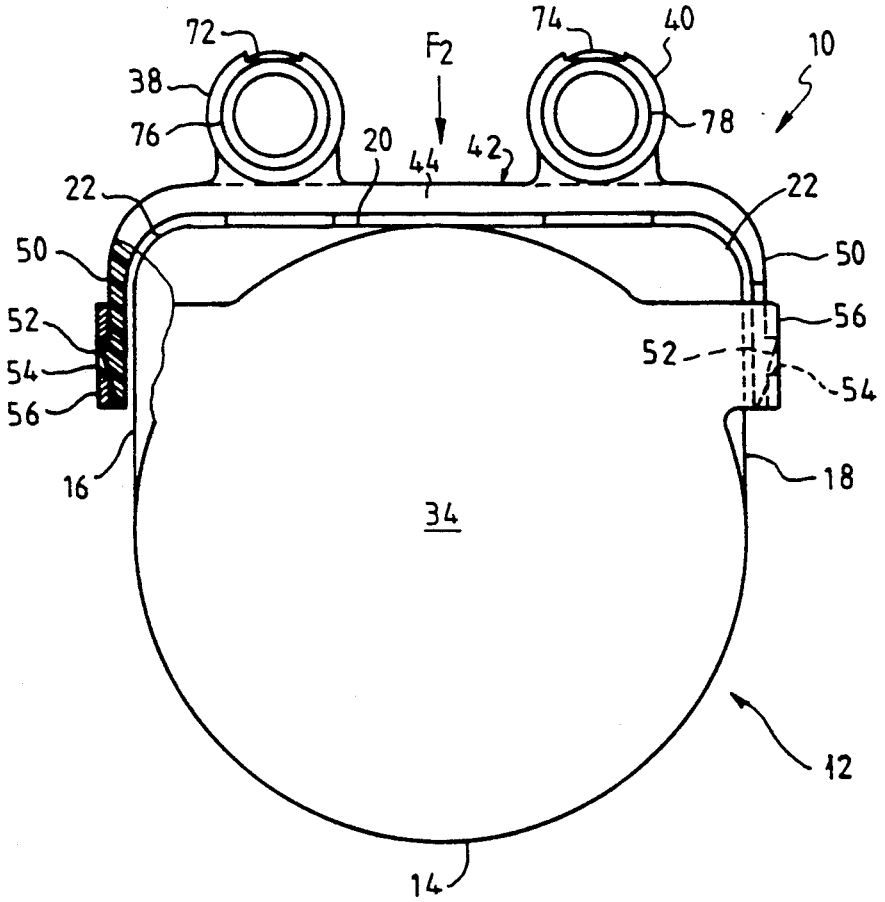
FIG. 1 is a plan view, shown partly cut away, of a casing of a heat exchanger having a mounting device in accordance with the present invention.
Figure 2:
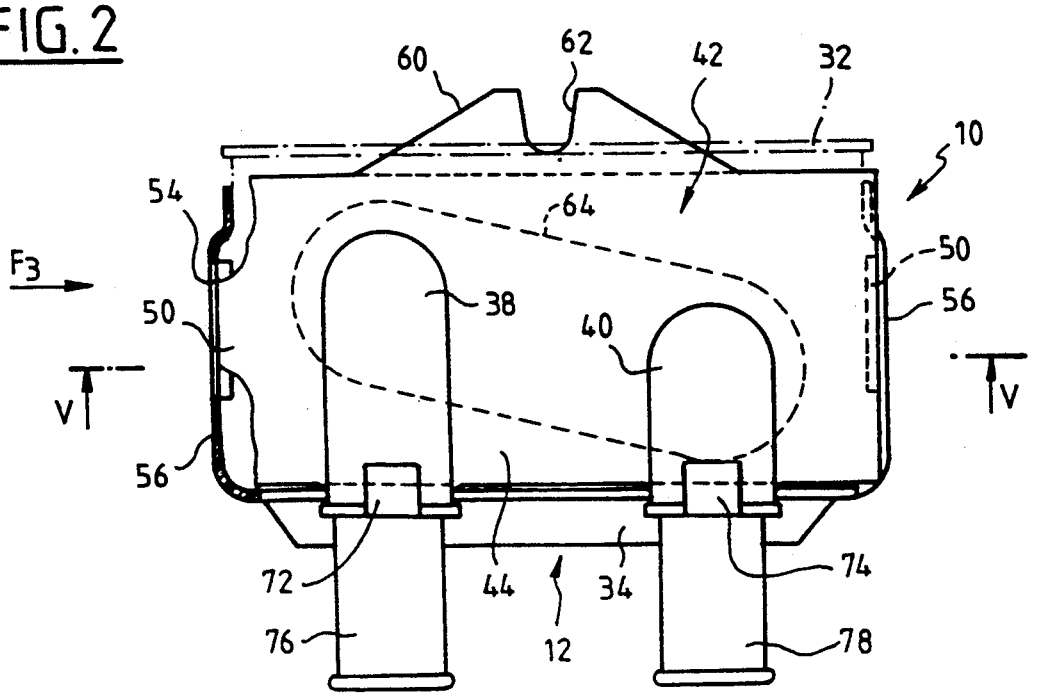
FIG. 2 is a plan view, again partly cut away, as seen in the direction of the arrow F2 in FIG. 1.
Figure 3:
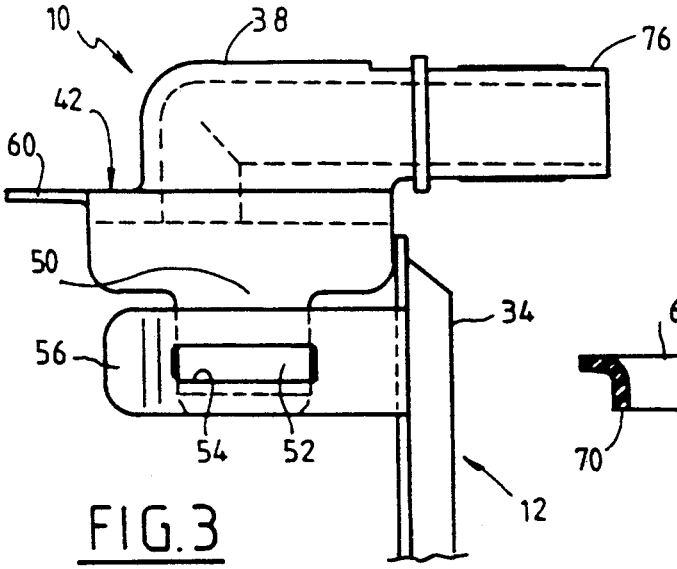
FIG. 3 is a partial plan view seen in the direction of the arrow F3 in FIG. 2.

As can be seen most particularly in FIG. 2, the two tongues 56 are joined at right angles to the cover plate 34 and extend substantially parallel to each other. During the snap-fitting operation, the two flexible lugs tend to move closer together, subsequently moving further apart when the ramp teeth 52 have penetrated into the corresponding holes 54 in the tongues 56. The two tongues 56 and the cover plate 34 from which they project are preferably formed integrally with each other, for example in a metal such as aluminium. On the other hand the base plate 42, together with the two pipe connections 38 and 40 and the two flexible lugs 50, are preferably made integrally with each other by moulding in a plastics material, for example of the polyamide type.

In this particular embodiment, and as can be seen best in FIG. 5, each ramp tooth 52 has a ramp wall 58 inclined at an angle Á, which is for example 15 degrees, with respect to the general direction of the flexible lug 50.

As shown in FIG. 2, the base plate 42 includes an extension portion 60, which defines a slot 60 that serves for example to locate the heat exchanger on the engine casing of the vehicle.

Figure 4:
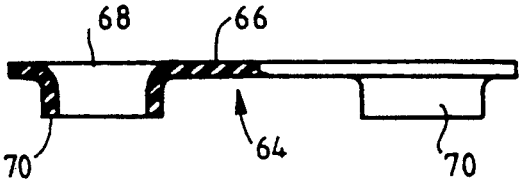
FIG. 4 is a side view, partly cut away, showing the sealing member in the mounting device of the invention.

A sealing member 64 is fitted in the space which is defined between the side wall 20 of the casing 12 and the body portion 44 of the base plate 42. The sealing member 64, which is shown by itself in FIG. 4, includes a body portion 66, generally oblong in shape and having two apertures 68 formed through it. The apertures 68 are spaced apart by the same distance as the apertures 24 of the casing and the orifices 46 of the base plate 42. Each of the apertures 68 is surrounded by a cylindrical collar portion 70. The sealing member 64 is made of a compressible material, for example an elastomer, such that during snap-fitting of the base plate 42 on to the casing 12, each of the collar portions 70 is compressed between the collar portion 26 of the corresponding aperture 24 of the casing and the collar portion 48 of the corresponding orifice 46 of the base plate 42.

As can be seen best in FIG. 2, the pipe connections 38 and 40 are formed with slots which are indicated at 72 and 74 respectively. The purpose of these slots is to locate an external pipe, which is arranged to slide over the connecting tube section 76, 78 forming the longer arm of the L-shaped pipe connection 38 or 40 respectively.

The invention enables the two pipe connections to be fitted simultaneously by snap-fitting the base plate 42 on to the casing 12 in a single operation. In particular, the invention makes it possible to provide bent pipe connections which are very much smaller in size than those bent pipe connections which have hitherto required to be brazed on to the casing of the heat exchanger.

Although the invention has been described above with particular reference to a heat exchanger of the oil cooling radiator type, it may be used for other heat exchangers for motor vehicles.

What is claimed is:

1. A housing for a heat exchanger having a casing formed with two first through apertures adjacent to each other, a base plate carried on the casing and having two orifices aligned respectively with the said first apertures, and a sealing member interposed between the said base plate and casing in the region of the first apertures and the said orifices, wherein the heat exchanger further comprises snap-fitting means carried by the casing and base plate for cooperation with each other so as to attach the base plate to the casing, and two tubular pipe connections joined to the base plate and communicating with the said orifices in the latter.

2. A housing for a heat exchanger according to claim 1, wherein the base plate has two flexible tabs extending in directions substantially parallel to each other, the snap-fitting means comprising two tongues fixed to the casing, each tongue being formed with a hole, and a tooth carried by each flexible tab of the base plate for snap-fitting engagement in the said hole of a corresponding one of the tongues.

3. A housing for a heat exchanger according to claim 2, wherein the casing includes a cover plate, each said tongue projecting from the cover plate, the casing further including a side wall and the said first apertures being formed in the side wall.

4. A housing for a heat exchanger according to claim 1, wherein the casing includes first collar portions projecting towards the interior of the casing, with each first collar portion surrounding a respective one of the said first apertures, the base plate having second collar portions, each surrounding a respective one of the said orifice of the base plate and being arranged to be introduced into the corresponding first aperture of the casing.

5. A housing for a heat exchanger according to claim 4, wherein the sealing member comprises a body portion defining two second apertures formed through the body portion, and two cylindrical third collar portions each surrounding a respective one of the said second apertures, whereby, when the base plate is snap-fitted on to the casing, each said third collar portion is compressed between the corresponding first and second collar portions.

6. A housing for a heat exchanger according to claim 1, wherein the base plate defines a locating slot.

7. A housing for a heat exchanger according to claim 1, wherein each said tubular pipe connection is of bent configuration.

8. A housing for a heat exchanger according to claim 1, wherein each tubular pipe connection defines a slot for locating a pipe for attachment to the heat exchanger.

9. A housing for a heat exchanger according to claim 1, wherein the base plate and the tubular pipe connections are formed integrally with each other by moulding in a plastics material.

* * * * *